United States Patent [19]

Gill

[11] 4,121,521

[45] Oct. 24, 1978

[54] INKING WHEEL HAVING RESILIENT INKER SUPPORT

[75] Inventor: Bernard J. Gill, Dundee, Ill.

[73] Assignee: Kiwi Coders Corporation, Wheeling, Ill.

[21] Appl. No.: 811,166

[22] Filed: Jun. 29, 1977

[51] Int. Cl.[2] ..... B41L 27/28

[52] U.S. Cl. ..... 101/348; 29/130

[58] Field of Search ..... 101/348, 349, 327, 328, 101/329, 330, 376, 375; 29/130, 131

[56] References Cited

U.S. PATENT DOCUMENTS

| | | | |
|---|---|---|---|
| 2,982,205 | 5/1961 | Maul | 101/269 |
| 3,421,437 | 1/1969 | Funahashi | 101/327 X |
| 3,592,134 | 7/1971 | Patterson, Jr. | 101/269 |
| 3,625,143 | 12/1971 | Nettesheim | 101/327 |
| 3,678,848 | 7/1972 | Roser et al. | 101/327 |
| 3,968,747 | 7/1976 | Johnson | 101/376 |

*Primary Examiner*—J. Reed Fisher

*Attorney, Agent, or Firm*—Silverman, Cass & Singer

[57] ABSTRACT

An inking wheel having an outer ring of firm inking material, the outer ring being mounted upon a radially yieldable support assembly, said support assembly formed of a pair of relatively rigid concentric cylindrical sleeves and a resilient cushioning material disposed between said sleeves. The inking wheel can be mounted upon a shaft, a hub or mounting spindle. Axial disks can be provided to restrain axial movement of the ring and the support assembly.

16 Claims, 8 Drawing Figures

INKING WHEEL HAVING RESILIENT INKER SUPPORT

BACKGROUND OF THE INVENTION

This invention relates generally to rotary inking devices for use in apparatus for applying printed indicia upon a moving line of articles and in particular, is concerned with the provision of an inking wheel having an relatively firm outer ring of inking material mounted upon a radially yieldable support assembly whereby a constant pressure may be exerted upon the inking material without deterioration thereof materially to extend the useful life of said ring.

Conventional inking wheels, such as utilized with apparatus for imprinting linearly moving packages, carry ink absorbent circumferential surfaces formed of sponge or foam materials to which printing ink is applied from ink reserviors at the time of use. Microporous rings pre-impregnated with printing ink also are conventional and are capable of being used without ink reserviors and applicators. Generally, the use of the microporous members carrying their own supply of ink has gained substantial commercial acceptance. The ink is held in suspension within the ring material and flows instantly to the circumferential surface of the ring when needed by engagement with the type surface or transfer roller of the imprinting apparatus.

Notwithstanding the advantages of using pre-inked inking members, difficulties have been encountered which limit their use. The outer circumferential surface of the pre-inked rings often generally is formed of a relatively high density, hard surfaced material which does not permit the type to be sufficiently impressed so that the application of ink thereto may be less effective than would be the case if foam or spongy material were used. Further, in the case of the pre-inked microporous plastic material, as the ink content is reduced during use, the roll diameter decreases as a result of the cellular structure of the ring collapsing or shrinking. Adjustment devices must be utilized and these are often expensive, such as when camming arrangements must be provided to adjust the position of the inking wheel relative to the imprinting wheel carrying the type faces. It would be more expedient and less expensive to utilize spring biasing rather than camming arrangements but pressure contact involved would be likely materially to reduce the useful life of the inking ring. Use of adjustment screws would not be feasible because continuous monitoring by the operator is required.

Accordingly, it would be desirable to provide an inking wheel having an inking surface which is capable of being driven pressed against the circumferential surface of an imprinting wheel without reducing the useful life of the inking wheel.

SUMMARY OF THE INVENTION

An inking wheel for transferring ink to a printing member in a rolling contact engagement comprising an outer ring of firm ink absorbent material, and a support for receiving said ring in coaxial frictional engagement therewith, said support comprising a resilient annular member capable of limited radial movement relative the axial center of said wheel, said support also having an inner core to enable engagement thereof upon a shaft, a hub or a spindle for rotation therewith.

In particular, the support assembly is formed of a pair of concentrically arranged cylindrical sleeves of differing diameter with a sponge-like resilient material disposed therewith.

DESCRIPTION OF PREFERRED EMBODIMENTS

Figure 1:
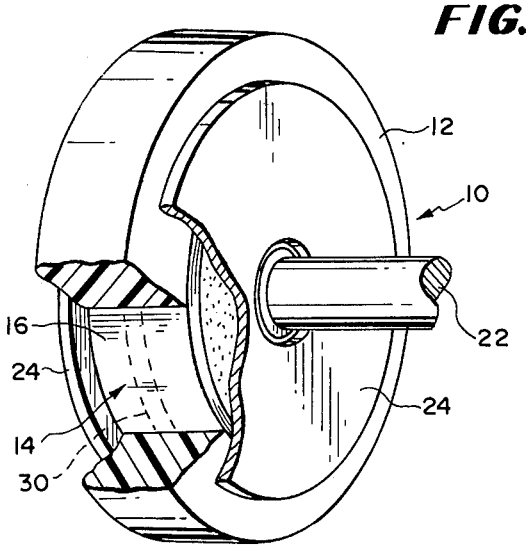
FIG. 1 is a perspective view of an inking wheel constructed in accordance with the invention and illustrated mounted upon a shaft, portions being broken away to illustrate details.
Figure 2:
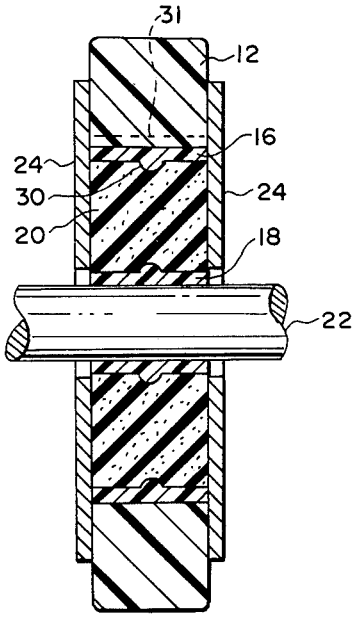
FIG. 2 is a vertical sectional view taken transversely through the inking wheel of FIG. 1.

The inking wheel according to the invention shall be designated generally by reference character 10 in FIG. 1 and comprises an annular ring 12 of pre-inked microporous cellular material having a generally rectangular cross-section, the consistency of the ring being firm. The ring 12 is mounted on a support assembly 14 formed of a pair of relatively rigid, cylindrical sleeves 16 and 18 of different diameter concentrically arranged one relative to the other and having an intermediate cushion 20 of resilient material sandwiched between said sleeves. The inner sleeve 18 can be slightly wider than the outer sleeve 16 so that its ends can extend outwardly from the axial sides of the wheel 10. The cushion 20 may be formed of foam or sponge or similar natural or synthetic cellular material. The sleeve 18 has an inner diameter selected frictionally to receive a shaft 22. Side-disks 24 may be utilized to restrain the ring 12 and support assembly 14 against axial movement. These disks may be a part of the mounting assembly of the printing apparatus or may comprise thin circular members fastened to opposite sides of the wheel 12, as mentioned later, and being capable of limited radial freedom of movement with the ring 12 and sleeve 16. In other words, the ring 12 and sleeve 16 together float relative to sleeve 18.

Figure 4:
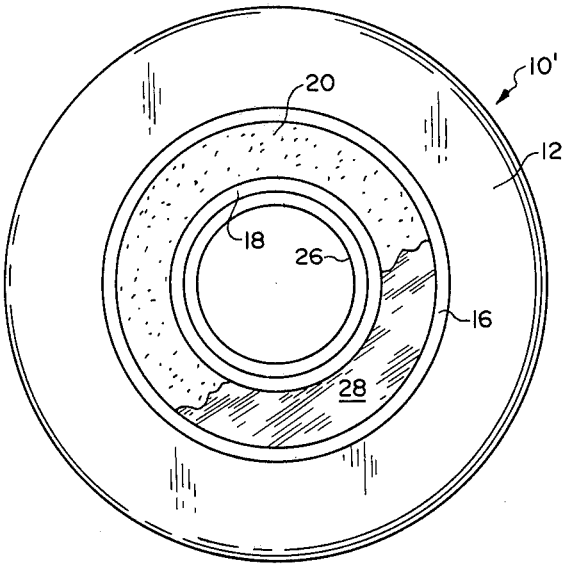
FIG. 4, is a side elevational view of a slightly modified inking wheel according to the invention

The inking wheel 10 may be modified, as represented by reference character 10' in FIG. 4 to include a cylindrical hollow sleeve 26 functioning as a mounting hub, say for slidable engagement upon a mounting spindle say of a marking apparatus (not shown). The hub 26 may have an annular disk secured to one end thereof, said disk carrying a friction band for use in propelling the inking wheel in use, the hub slippable onto the mounting spindle, (not shown), the mounting spindle carrying a disk support for the other side of the wheel 10. The inner diameter of ring 18 is selected to effect a frictional engagement with the hub 26 which can be slipped onto the spindle (not shown), say on a marking apparatus. Preferably, the cushion 20 is formed of the closed cell configuration and preferably is not ink absorbent. If some absorbency is present, the cushion ends at least and perhaps the support assembly 14 itself, may be sealed by ink impervious barrier 28 to prevent passage of ink axially. Axial shields in the form of annular ring-like inserts for example, may be vulcanized onto the cushion material to seal off the assembly 14 axially. It is contemplated that the absorbent cushion 20 may be molded onto the inner ring 18 or may be punched to a doughnut configuration.

The sleeves 16 and 18 preferably are formed of rigid plastic material and may carry annular ribs or protrusions 30 for restraining axial movement of the spongy resilient cushion material disposed between the sleeves. Axial ribs 31 also may be provided instead of or in addition to the annular ribs. They function to aid the frictional engagement of the assembly 14 upon the hub or shaft, and of the inking ring 12 on sleeve 16, and to restrain axial and/or independent movement of the ring relative to the outer sleeve 16 of support assembly 14. The presence of ribs or protrusions also enables easing of manufacturing tolerances without loss in the effective engagement of the inking ring 12 on the sleeve 16 and/or of the wheel on the shaft or hub.

Figure 6:
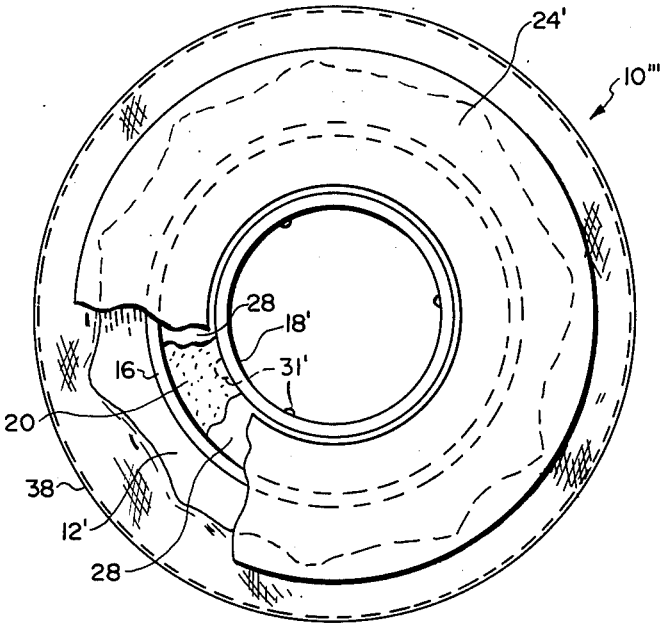
FIG. 6 is a side elevational view of a still further embodiment of the invention portions being broken away to show interior detail.
Figure 7:
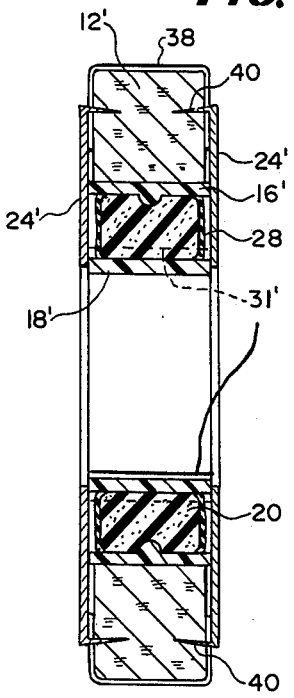
FIG. 7 is a vertical section taken transversely through the inking wheel of FIG. 6.

The material desirably utilized to form the inking ring 12 comprises a microporous plastic, preimpregnated with printing ink, and sold under the trademark PORELON by Porelon, Inc. of Racine, Wis. An inking ring may be formed of a relatively rigid fibrous material such as a material formed of cellulose fiber and a phenolic resin which is commercially used for water filters. A woven sleeve can be employed as an outer skin as is illustrated in FIGS. 6 and 7.

Figure 3:
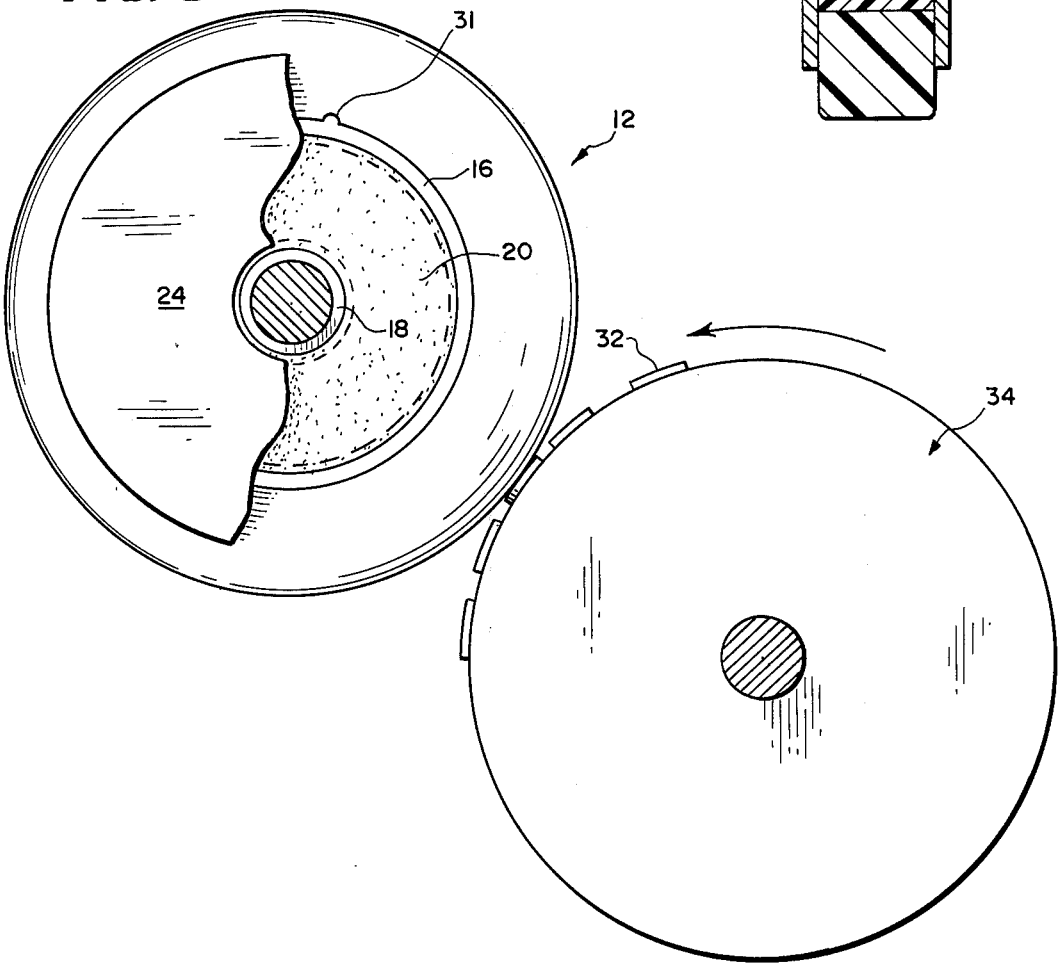
FIG. 3 is a side elevational view of the inking wheel of FIG. 1, portions of which are broken away and are shown in section, the wheel being shown operably engaged with an imprinting wheel.
Figure 4A:
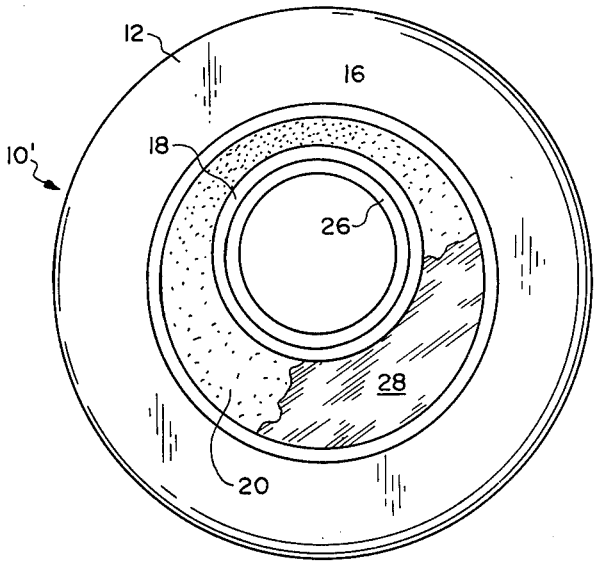
FIG. 4*a* illustrates the radial yieldability characteristic of the inking ring support assembly of said inking wheel.

The inking wheel 10 according to the invention is capable of use in conjunction with operations where either constant or intermittent contact with the imprinting type 32 carried by print wheel 34 (FIG. 3) occurs. Adjustment means (not shown) preferably are employed to position the inking ring 12 against the type 32 so that firm contact is made. Compensation is provided by the "give" permitted by the support 14. The outer sleeve 16 has limited radial and axial freedom of movement relative to the inner sleeve 18 due to the resilience of the cushion 20. The axial movement generally is restricted when the wheel is installed, or by the disks 24. Thus, relative movement is limited to the radial direction relative to the inner sleeve 18, as shown in FIG. 4*a* in exaggerated representation. The radial "give" serves materially to reduce the collapse of the cellular structure of the inking ring as the ink content thereof is reduced. This in turn reduces shrinkage which would otherwise result in significant reduction in ring diameter. This assures that the positioning means are effective to assure continued firm engagement of the inking ring 12 with the type 32 carried by the imprinting wheel 34 far longer than would be expected, without flattening or grooving of the ring and with resultant maintenance of the dimensional stability of the inking ring. Also, there is assurance against skipping portions of the type which may differ in height from the other of the type. The contact is sufficient to effect a controlled ink flow with reduction in voids encountered in use of the conventional inking wheels which employ pre-inked inking rings. Sleeves 16 and 18 of the same width are preferable but not mandatory to function as the support 14.

Although intended primarily for use with pre-inked inking rings, the support assembly 14 described above is useful with inking rings which may be inked in situ utilizing ink reserviors, applicators and/or transfer rollers.

Figure 5:
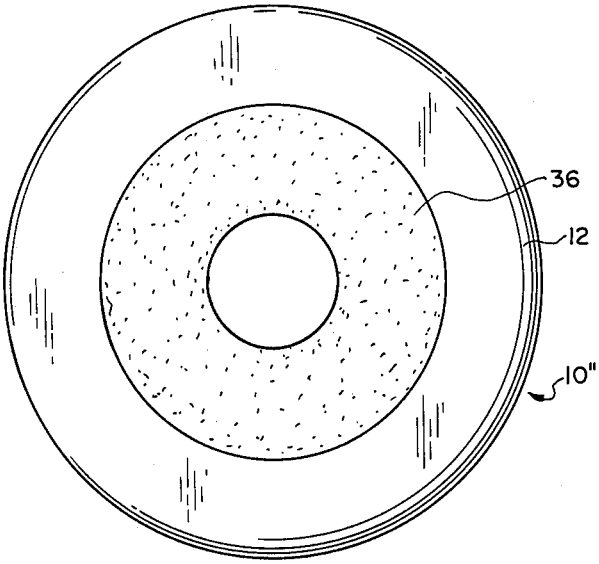
FIG. 5 is a side elevational view of another embodiment of the inking wheel according to the invention.

Referring to FIG. 5, a modified embodiment of the invention is represented by reference character 10″. It is contemplated that the firm inking ring 12 may be mounted directly to a resilient cylindrical body or core 36 (FIG. 5) absent one or both of concentric sleeve members 16″ and 18″. Such core may be formed of material less resilient than the material of which the cushion 20 is formed but yet would provide sufficient radial "give" enabling limited radial freedom of movement.

In FIGS. 6 and 7, a further modified embodiment 10‴ of the invention is illustrated. In inking wheel 10‴, the inking ring 12′ is formed of a relatively hard yet ink absorbent material formed of a cellulose filter material such as employed for use as a water filter. A sleeve 38 of woven expansible material is fastened about the inking ring 12′ and serves as a protection to prevent particles possibly flaking off the ring 12′ from fouling the ink or the type surface during use. The textile sleeve also forms a good applicator for transferring the ink from the ring 12′ to the type. The outer ring 16′ may be provided with plural axial protrusions or ribs 30′ enabling a friction fit to be established without requiring close tolerances to be maintained for the ring 12′ or for the ring 16′. Annular thin plates 24′ preferably of metal and having barbs 40 are pressed into the ring 12′ to retain the sleeve 38 on the ring 12′ and to shield the opposite sides of the assembly. The plates 24′ have a central circular opening of inner diameter slightly greater than the outer diameter of ring 18′ so that the radial give of the wheel 10‴ about the inner sleeve 18′ is retained. Inking ring 12′ is reinkable when depleted. Likewise, the support assembly 14 is reusable and need not be discarded as it is not fouled with ink. With a closed cellular material molded or stamped to form the cushion ring 20, a direct engagement may be effected between the ring 20 and the mounting hub 26. the ring 20 not being too resilient so that there is some resistance to the impact of the type, such resistance being believed necessary to bring out the impregnated ink from the intercellular structure of the ring 12′ to its surface. Sleeves 16′ and 18′ are of equal width. In fact, one of the sleeves can be omitted.

What I claim is:

1. An inking wheel for transferring ink to a printing member in a rolling contact engagement comprising an outer ring of ink absorbent material, and a support for receiving said ring in coaxial frictional engagement therewith, said support comprising a pair of concentrically arranged cylindrical rigid sleeves and a resilient annular member formed of a sponge-like resilient material disposed between said sleeves, said support being capable of limited radial movement relative to the axial center of said wheel, said support being capable of being engaged upon a hub for rotation therewith.

2. The inking wheel as claimed in claim 1 in which said resilient material is one of natural and synthetic foamed material.

3. The inking wheel as claimed in claim 1 and means comprising a rigid tubular inner core engaged concentrically within the inner one of said sleeves to enable engagement of said support upon the hub.

4. The inking wheel as claimed in claim 1 in which said support includes means sealing off at least one of the axial ends of said support.

5. The inking wheel as claimed in claim 4 in which said sealing means comprises an ink impervious material.

6. The inking wheel as claimed in claim 1 in which said annular member is molded.

7. The inking wheel as claimed in claim 1 in which said resilient member is secured to at least one of said sleeves.

8. The inking wheel as claimed in claim 1 in which said sleeves are of the same width.

9. The inking wheel as claimed in claim 1 in which said annular member is formed of a closed cellular material.

10. The inking wheel as claimed in claim 1 and protrusion means formed on at least one of said sleeves of said support and cooperating with said resilient member frictionally to restrain axial movement thereof.

11. The inking wheel as claimed in claim 10 and second protrusion means formed on the outer circumference of the outer sleeve of said support cooperating with said inking ring frictionally to restrain against rotary slippage of said inking ring relative to said support.

12. The inking wheel as claimed in claim 11 wherein said second protrusion means comprise at least one axial rib.

13. The inking wheel as claimed in claim 10 and wherein said protrusion means comprise annular ribs.

14. The inking wheel as claimed in claim 1 and flat disk means engagable with opposite sides of the inking ring coaxial therewith for restraining axial movement of said inking ring and said support and not interferring with the limited radial movement of said inking ring.

15. The inking wheel as claimed in claim 1 and flat disk means secured to opposite sides of the inking ring coaxial therewith.

16. The inking wheel as claimed in claim 1 and a sleeve of woven material fastened about the said inking ring.

* * * * *